US009599364B2

(12) United States Patent
Bahar et al.

(10) Patent No.: US 9,599,364 B2
(45) Date of Patent: Mar. 21, 2017

(54) ELECTROCHEMICAL COMPRESSOR BASED HEATING ELEMENT AND HYBRID HOT WATER HEATER EMPLOYING SAME

(71) Applicant: Xergy LTD, Georgetown, DE (US)

(72) Inventors: Bamdad Bahar, Georgetown, DE (US); William Paul Parmelee, Seaford, DE (US); Steven K Naugler, Hockessin, DE (US); Natarajan Venkatakrishnan, Louisville, KY (US); Brent Alden Junge, Evansville, IN (US)

(73) Assignee: Xergy LTD (GB)

( * ) Notice: Subject to any disclaimer, the term of this patent is extended or adjusted under 35 U.S.C. 154(b) by 0 days.

(21) Appl. No.: 14/859,267

(22) Filed: Sep. 19, 2015

(65) Prior Publication Data

US 2016/0084534 A1 Mar. 24, 2016

Related U.S. Application Data

(63) Continuation-in-part of application No. 13/899,909, filed on May 22, 2013, and a continuation-in-part of
(Continued)

(51) Int. Cl.
*F25B 27/00* (2006.01)
*F24H 1/18* (2006.01)
(Continued)

(52) U.S. Cl.
CPC ..... *F24H 1/185* (2013.01); *F24H 4/04* (2013.01); *F24H 9/2021* (2013.01); *F25B 30/02* (2013.01); *F25B 2339/047* (2013.01)

(58) Field of Classification Search
CPC .... F25B 30/02; F25B 2339/047; F25B 29/00; F24D 17/00; Y02B 90/16; Y02E 60/50
See application file for complete search history.

(56) References Cited

U.S. PATENT DOCUMENTS 1,925,281 A 3/1934 Ranque
2,913,511 A 11/1959 Grubb, Jr.
(Continued)

FOREIGN PATENT DOCUMENTS

AU WO 2007030856 A1 * 3/2007 ..... F24D 3/082
WO 0125700 A1 4/2001
WO 2008007108 A1 1/2008

OTHER PUBLICATIONS

"Engineering a Membrane Electrode Assembly," John W. Weidner et al., The Electrochemical Society Interface, Winter, 2003, pp. 40-43.

(Continued)

*Primary Examiner* — Elizabeth Martin
(74) *Attorney, Agent, or Firm* — Invention To Patent Services; Alex Hobson

(57) ABSTRACT

An electrochemical compressor type heat pump system is described. An electrochemical compressor compresses a mixed gas refrigerant whereby heat from the compression can be used to heat an object. The electrochemical compressor is capable of producing high pressure gas from a mixed fluid system including an electrochemically-active component, such as hydrogen, and at least one refrigerant fluid, for example water. Any suitable proton associable compound, such as any suitable ionic or polar solvent compound, may be used in the mixed gas refrigerant. The electrochemical compressor may be configured in a hot water heater along with a secondary type heating source to produce a hybrid hot water heater.

9 Claims, 7 Drawing Sheets

Related U.S. Application Data application No. 14/303,335, filed on Jun. 12, 2014, now abandoned, which is a continuation of application No. 12/626,416, filed on Nov. 25, 2009, now Pat. No. 8,769,972.

(60) Provisional application No. 61/688,785, filed on May 22, 2012, provisional application No. 61/200,714, filed on Dec. 2, 2008.

(51) Int. Cl.

| | |
|---|---|
| ***F24H 4/04*** | (2006.01) |
| ***F24H 9/20*** | (2006.01) |
| ***F25B 30/02*** | (2006.01) |

(56) References Cited

U.S. PATENT DOCUMENTS

| | | | | |
|---|---|---|---|---|
| 3,432,355 | A | 3/1969 | Niedrach et al. | |
| 3,489,670 | A | 1/1970 | Maget | |
| 3,994,142 | A | 11/1976 | Kramer | |
| 4,118,299 | A | 10/1978 | Maget | |
| 4,173,872 | A | 11/1979 | Amthor, Jr. | |
| 4,386,500 | A | 6/1983 | Sigafoose | |
| 4,402,817 | A | 9/1983 | Maget | |
| 4,523,635 | A | 6/1985 | Nishizaki et al. | |
| 4,593,534 | A | 6/1986 | Bloomfield | |
| 4,829,785 | A | 5/1989 | Hersey | |
| 4,990,412 | A | 2/1991 | Hersey | |
| 5,024,060 | A | 6/1991 | Trusch | |
| 5,547,551 | A | 8/1996 | Bahar et al. | |
| 5,599,614 | A | 2/1997 | Bahar et al. | |
| 5,635,041 | A | 6/1997 | Bahar et al. | |
| 5,746,064 | A | 5/1998 | Tsenter | |
| 5,758,820 | A * | 6/1998 | Celorier, Jr. | G05D 23/1931 237/2 B |
| 5,768,906 | A | 6/1998 | Tsenter | |
| 5,900,031 | A | 5/1999 | Bloomfield | |
| 5,976,724 | A | 11/1999 | Bloomfield | |
| 5,993,619 | A | 11/1999 | Bloomfield et al. | |
| 6,068,673 | A | 5/2000 | Bloomfield | |
| 6,167,721 | B1 | 1/2001 | Tsenter | |
| 6,254,978 | B1 | 7/2001 | Bahar et al. | |
| 6,321,561 | B1 | 11/2001 | Magel | |
| 6,425,440 | B1 | 7/2002 | Tsenter et al. | |
| 6,553,771 | B2 * | 4/2003 | Tsenter | F04B 35/00 62/46.2 |
| 6,635,384 | B2 | 10/2003 | Bahar et al. | |
| 6,640,047 | B2 * | 10/2003 | Murahashi | F24H 1/18 126/344 |
| 6,994,929 | B2 | 2/2006 | Barbir et al. | |
| 2002/0066277 | A1 | 6/2002 | Tsenter | |
| 2002/0182462 | A1 * | 12/2002 | Ballantine | H01M 8/04007 429/431 |
| 2003/0155252 | A1 | 8/2003 | Juda et al. | |
| 2003/0196893 | A1 | 10/2003 | Mcelroy et al. | |
| 2004/0040862 | A1 | 3/2004 | Kosek | |
| 2004/0142215 | A1 | 7/2004 | Barbir et al. | |
| 2006/0230765 | A1 | 10/2006 | Fedorov et al. | |
| 2006/0254286 | A1 | 11/2006 | Johnson et al. | |
| 2008/0187794 | A1 | 8/2008 | Weingaetner | |
| 2008/0261093 | A1 | 10/2008 | Kelly et al. | |
| 2009/0308752 | A1 | 12/2009 | Evans et al. | |
| 2010/0209084 | A1 | 8/2010 | Nelson et al. | |

OTHER PUBLICATIONS

Technical Specifications for "HOGEN Hydrogen Generation Systems," Proton Energy Systems, Inc., Oct. 2008, 2 pages.

"Teledyne Titan(TM) HM Generator Series Hydrogen/Oxygen Gas Systems," Teledyne Energy Systems, Inc., Jun. 2007, 2 pages.

"A Comparative Study of Water as a Refrigerant with Some Current Refrigerants", International Journal of Energy Research, Int. J. energy res. 2005: 29.947-959.

* cited by examiner

Figure 4.1(J) - V/I polarization graphs for Hydrogen

Figure 4.1(K) - Hydrogen at different pressures

ELECTROCHEMICAL COMPRESSOR BASED HEATING ELEMENT AND HYBRID HOT WATER HEATER EMPLOYING SAME

CROSS REFERENCE TO RELATED APPLICATIONS

This application is a continuation in part of U.S. patent application Ser. No. 13/899,909 filed on May 22, 2013, entitled Electrochemical Compressor Based Heating Element And Hybrid Hot Water Heater Employing Same and currently pending, which claims the benefit of U.S. provisional patent application No. 61/688,785 filed on May 22, 2012 and entitled Electrochemical Compressor Based Heat Pump For a Hybrid Hot Water Heater, and this application is a continuation in part of U.S. Ser. No. 14/303,335, filed on Jun. 12, 2014, entitled Electrochemical Compressor and Refrigeration System and currently pending, which is a continuation of U.S. patent application Ser. No. 12/626,416, filed on Nov. 25, 2009, entitled Electrochemical Compressor and Refrigeration System and currently issued as U.S. Pat. No. 8,769,972, and which claims the benefit of U.S. provisional patent application No. 61/200,714, filed on Dec. 2, 2008 and entitled Electrochemical Compressor and Heat Pump System; the entirety of each related application is hereby incorporated by reference.

BACKGROUND OF THE INVENTION

Field of the Invention

The present invention relates to electrochemical compressors based heating element and the use thereof in hot water heater system. In one embodiment, an electrochemical compressor is configured as part of a chased loop refrigerant cycle.

Background

Domestic hot water heaters account for between 15% and 40% of domestic energy use depending on the country, with the U.S. reporting 15%. Tank type Hot Water heaters are typically either gas or electrically heated. One development for increasing the efficiency of hot water heaters has been the incorporation of heat pumps for base load heating. The system can be set so the heat pump is the primary heating device for maximum efficiency and slower recovery or utilized when whenever the water consumption rate is low having minimum impact on how the device is utilized at an efficiency penalty.

The function of heat pumps is to remove heat from a heat source or reservoir at low temperature and to reject the heat to a heat sink or reservoir at high temperature. While many thermodynamic effects have been exploited in the development of heat pumps and refrigeration cycles, one of the most popular today is the vapor compression approach. This approach is sometimes called mechanical refrigeration because a mechanical compressor is used in the cycle. Any improvement in efficiency related to compressor performance can have significant benefits in terms of energy savings and thus have significant positive environmental impact.

Vapor compression heat pump cycles generally utilizes five important components. The first is a mechanical compressor that is used to pressurize a gaseous working fluid. After proceeding through the compressor, the hot pressurized working fluid is condensed in a condenser. The latent heat of vaporization of the working fluid is given up to a high temperature reservoir often called the sink. The liquefied working fluid is then expanded at substantially constant enthalpy in a thermal expansion valve or orifice. The cooled liquid working fluid is then passed through an evaporator. In the evaporator, the working fluid absorbs its latent heat of vaporization from a low temperature reservoir often called a source. The last component is the working fluid itself.

In conventional vapor compression cycles, the working fluid selection is based on the properties of the fluid and the temperatures of the heat source and sink. The factors in the selection include the specific heat of the working fluid, its latent heat of vaporization, its specific volume, and its safety. The selection of the working fluid affects the coefficient of performance of the cycle. In an electrochemical compressor the electrochemical characteristics of a potential working fluid is important. Fluids can be selected for active or passive participation in the compression system. An active material is driven through the compressor in a reversible redox reaction whereas passive working fluids are moved through the compressor by association with the electroactive species, in most cases H2.

For a refrigeration cycle operating between a lower limit, or source temperature, and an upper limit, or sink temperature, the maximum efficiency of the cycle is limited to the Carnot efficiency. The efficiency of a refrigeration cycle is generally defined by its coefficient of performance, which is the quotient of the heat absorbed from the sink divided by the net work input required by the cycle.

Any improvement in heat pump, systems clearly would have substantial value. Electrochemical energy conversion is considered to be inherently better than other systems due to their relatively high exergetic efficiency. In addition, electrochemical systems are considered to be noiseless, modular, and scalable and can provide a long list of other benefits depending on the specific thermal transfer application.

SUMMARY OF THE INVENTION

The invention is directed to an electrochemical compressor and heat pump system. In one embodiment, an electrochemical compressor, as described herein, comprises an electrochemical cell and a mixed gas refrigerant. The electrochemical cell is capable of producing high pressure gas from a mixed fluid system including an electrochemically-active component, such as hydrogen, and at least one refrigerant fluid, for example water. Any suitable proton associable compound, such as any suitable ionic or polar solvent compound, may be used in the mixed gas refrigerant. A proton associable compound includes, but is not limited to, low molecular weight alcohols, such as methanol, water and the like.

A heating device, as described herein, comprises an electrochemical compressor and a condenser that may be configured in thermal communication with an object to be heated. A heating device, as described herein, comprises an electrochemical compressor configured to elevate the temperature and pressure of a working fluid. In an exemplary embodiment, a working fluid comprises hydrogen and a proton associable compound, such as water. The electrochemical compressor comprises a membrane electrode assembly that comprises an anode, a cathode, and a cation exchange membrane located between the anode and cathode. In an exemplary embodiment, the cation exchange membrane comprises a perfluorosulfonic acid polymer, such as Nafion, available from E.I. Dupont, however, any suitable cation exchange material may be used. The anode, and cathode comprise a catalyst suitable for running the reactions as described herein. At the anode, hydrogen is oxidized into proton's and electrons. The protons are then transferred across the cation exchange membrane where the hydrogen is produced through a reduction reaction. A power supply may be coupled to the anode and cathode to drive the reactions and transfer the working fluid across the membrane electrode assembly. A working fluid inlet is coupled with the anode, or anode side of the electrochemical compressor and a working fluid outlet is coupled with the cathode, or cathode side of the electrochemical compressor. A condenser, as described herein, is coupled with the working fluid outlet, whereby the working fluid entering the condenser is condensed. In an exemplary embodiment, an electrochemical compressor comprises a conduit that is coupled with the working fluid outlet and with the working fluid inlet to create a closed loop system for the working fluid. The working fluid may then be transferred around the closed loop system, whereby heat may be extracted from the condensed working fluid.

In another embodiment, an electrochemical compressor configured in a closed loop system may further comprise an expansion valve and an evaporator, whereby the working fluid is transferred from the electrochemical compressor to the condenser, and from the condenser to the evaporator through the expansion valve, and wherein the device is configured as a heat pump system. An evaporator may be configured in thermal communication with an object to be cooled. For example, an evaporator may comprise evaporation coils and a fan may blow cooled air from the coils into a duct. The electrochemical compressor may be used as a cooling device in this embodiment.

A hot water heater may be configured with an electrochemical compressor, as described herein. Water within the hot water heater may be in thermal communication with the condenser and thereby extract heat from the condenser. A condenser of the electrochemical compressor may be configured at least partially within a hot water heater, or a thermal communication device, such as a heat sink may couple the condenser with the water within the tank. An electrochemical compressor, as described herein may further conduit to create a closed loop system that may incorporate an expansion valve couple with an evaporator, wherein the device is configured as a heat pump. The heat pump may be configured at least partially within a hot water heater. In an exemplary embodiment, the condenser is configured inside a hot water heater, whereby heat is transferred from the condenser to the water within the hot water heater and the evaporator is configured outside of the hot water heater.

A hot water heater comprising an heating device comprising an electrochemical compressor, as described herein, may also comprise a secondary heat source, such as an electric or gas heat source, whereby it may be consider a hybrid hot water heater. A hybrid hot water heater has two different types of heating sources, wherein a first heat source, such as the heating device described herein, may be used to heat the water during periods of no or low usage and a secondary heat source may be turned on when the demand is increased. The heating device as described herein is more efficient that most other heat sources and therefore using it to heat the water within a hot water heater can significantly increase the overall efficiency of the hot water system. A controller may be used to turn a first and second heat source on as required by the system. Any number of sensors may be used to provide input to the control, whereby the controller determines, through algorithms programed in a data processor, at what level of output each heat source should be. For example, hot water heater, as described herein, may comprise a flow rate sensor, whereby the controller only turns on the secondary heat source if the flow rate exceeds a preset value, or if the flow rate is high for an extended period of time. Likewise, a hot water heater may be configured with a temperature sensor that measures the temperature of the water within the hot water heater. A controller may use the water temperature data alone or in combination with other sensor inputs to control the output level of each heat source. A controller may simply send more current to an electrochemical compressor, or to an electrical secondary heat source as necessary. A water level sensor may also provide input to controller and the water level input may be used alone or in combination with any other sensor input to determine how to control the heat sources. A controller may control the amount of current supplied to an electrochemical compressor or control the voltage of the membrane electrode assembly. In addition, a controller may reverse the polarity on the electrochemical compressor is required.

A heat pump system, as described herein may comprise any suitable type of expansion valve, such as a thermostatic expansion valve, an electronically controlled expansion valve, a MEMs based electronically controlled expansion vale and the like.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
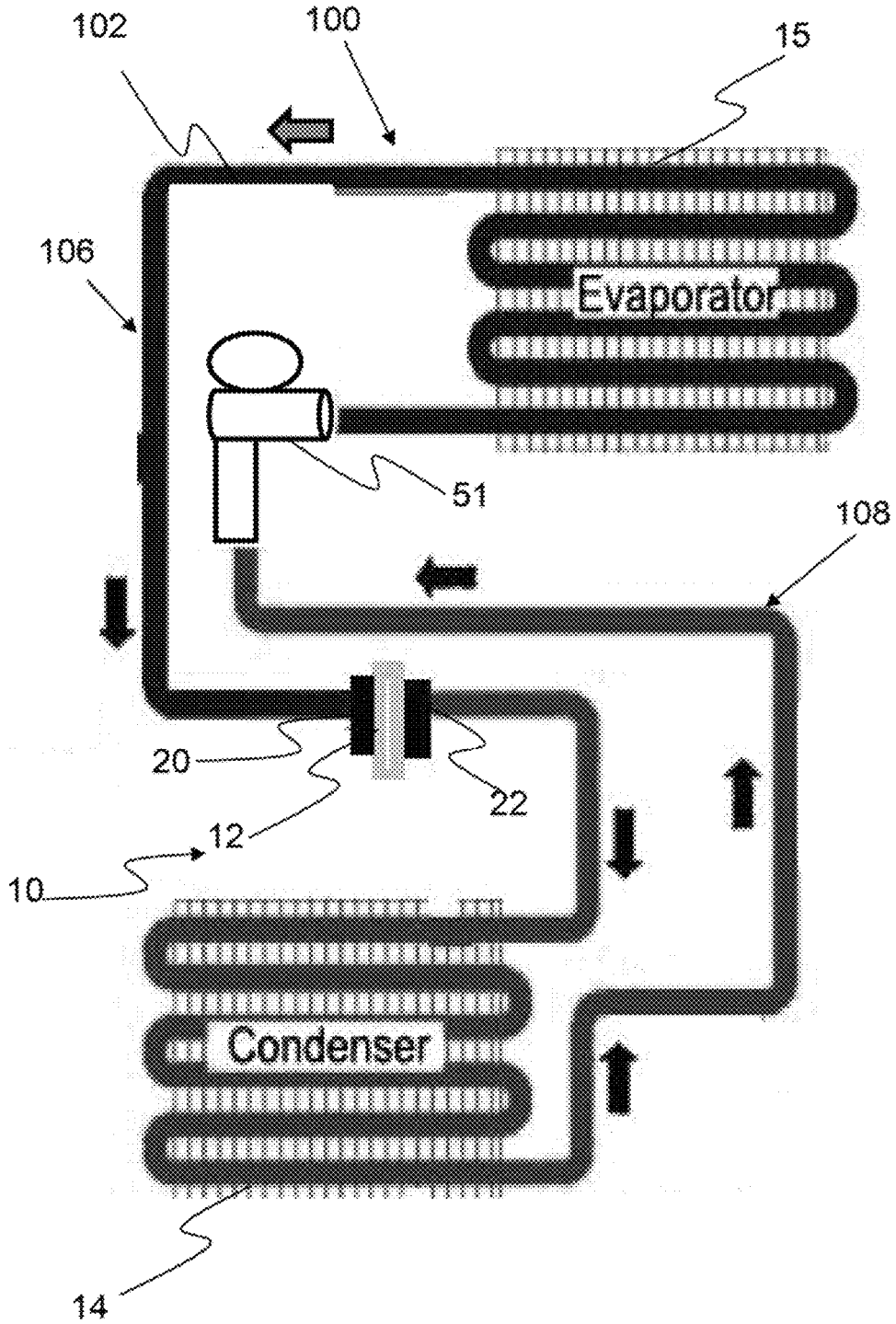

FIG. 1 shows a diagram of an exemplary heat pump system comprising an electrochemical compressor as described herein.

Figure 2:
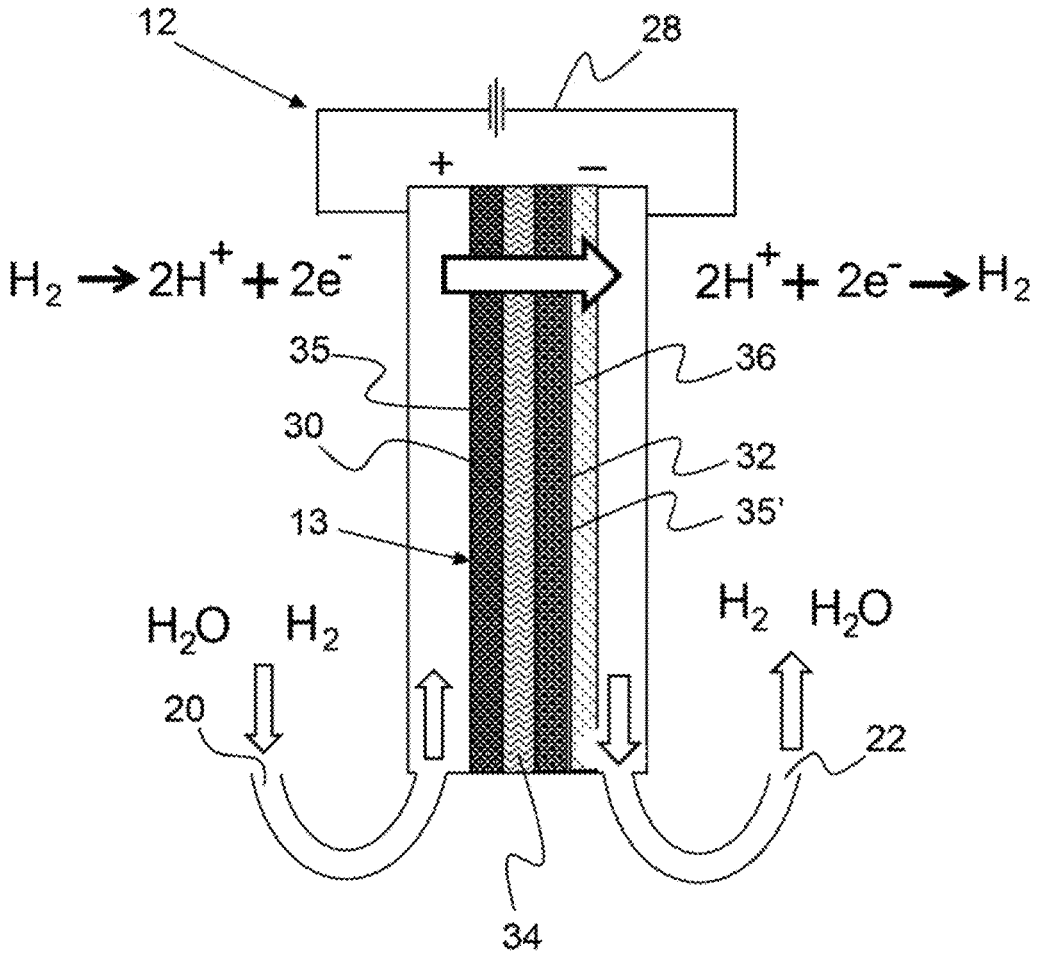

FIG. 2 shows an exemplary electrochemical compressor as described herein.

Figure 3:
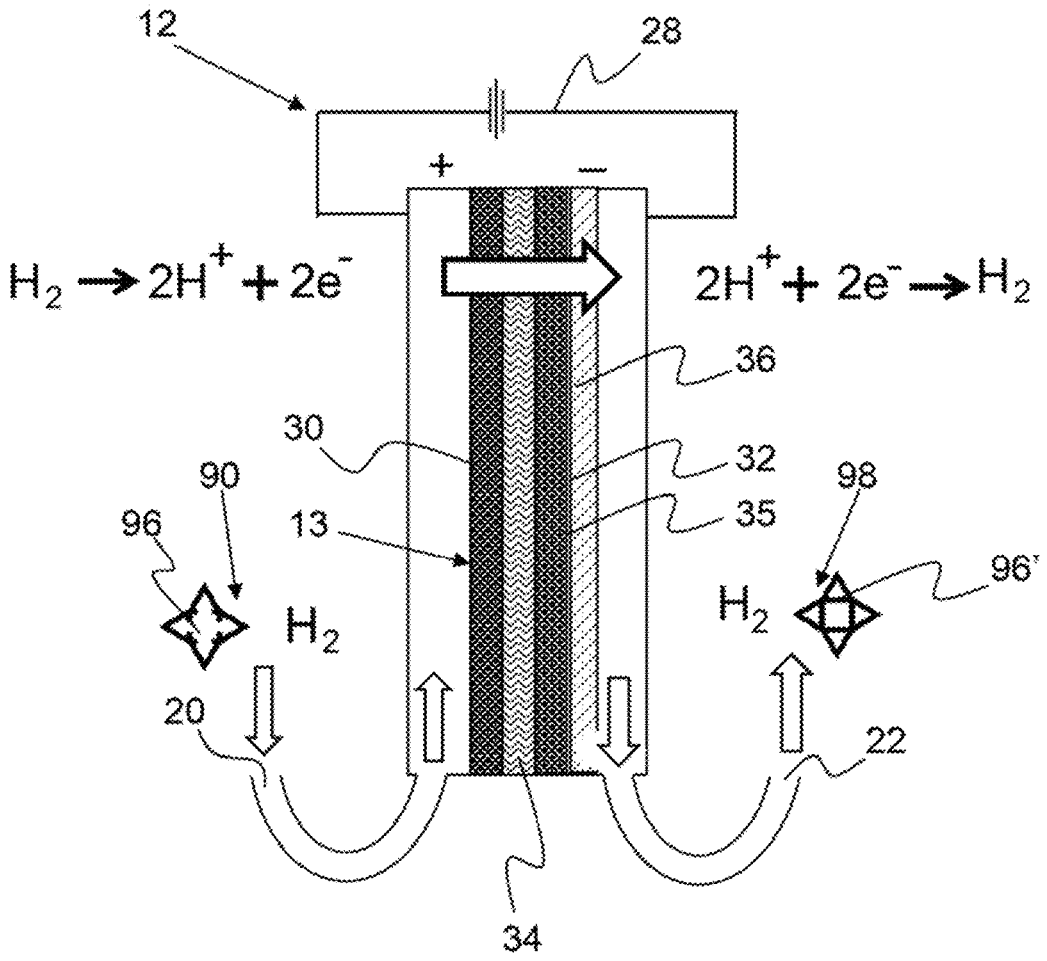

FIG. 3 shows an exemplary electrochemical compressor as described herein.

Figure 4:
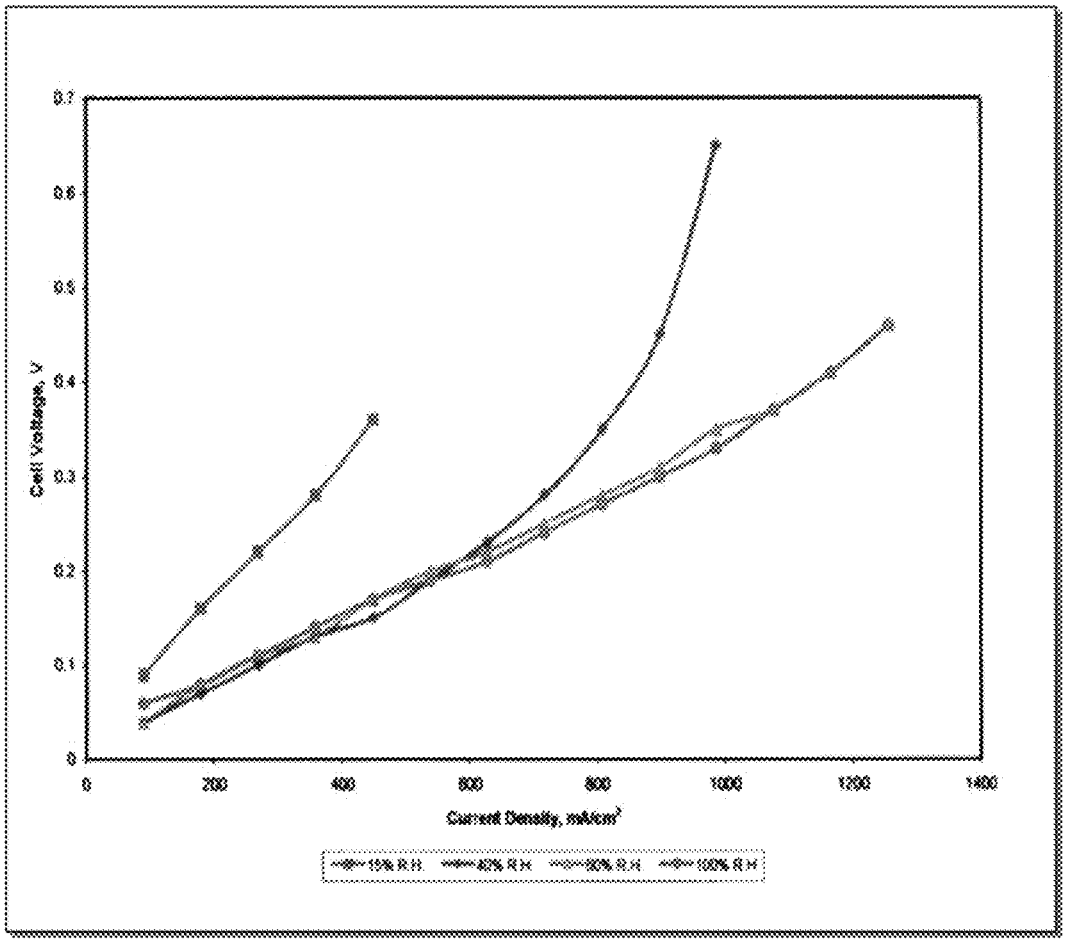
Figure 5:
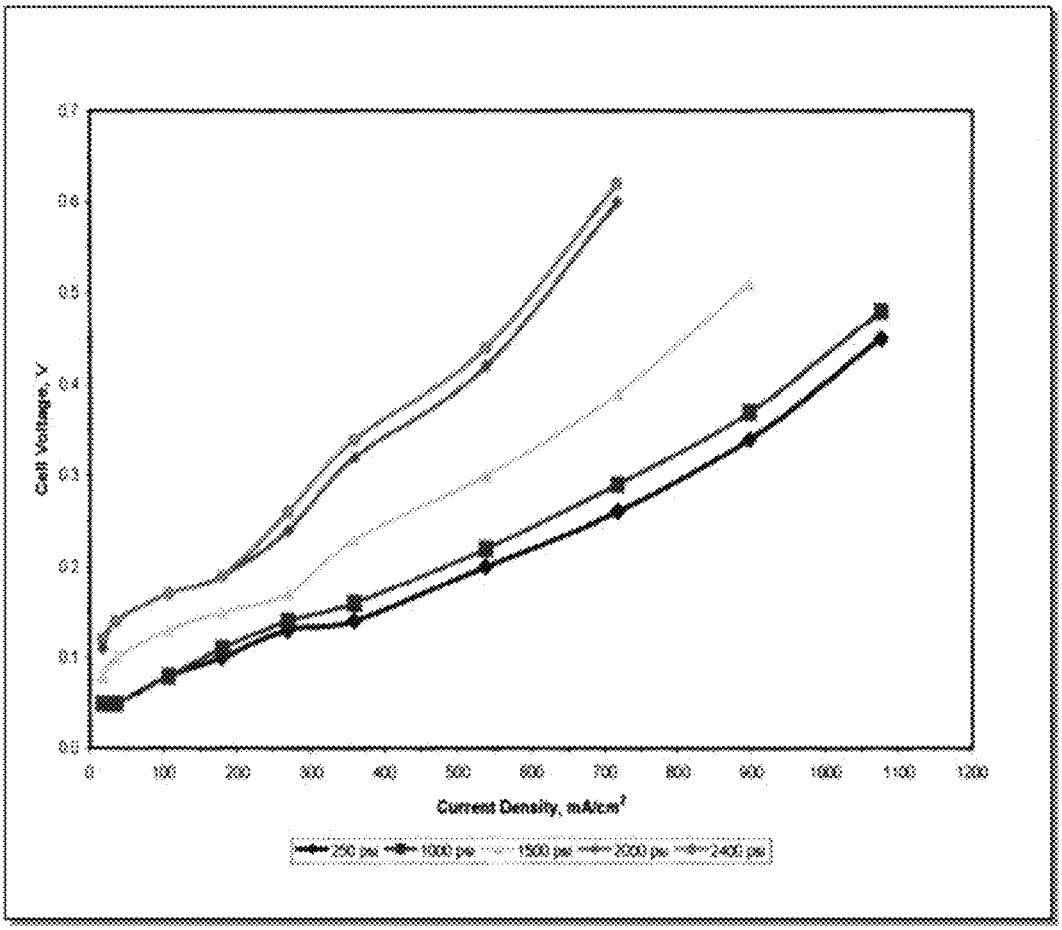

FIG. 4 shows an exemplary voltage (V) versus current (I) polarization graph for hydrogen gas at different relative humidity levels FIG. 5 shows an exemplary voltage (V) versus current (I) polarization graph for hydrogen gas compressed to different output pressures.

Figure 6:
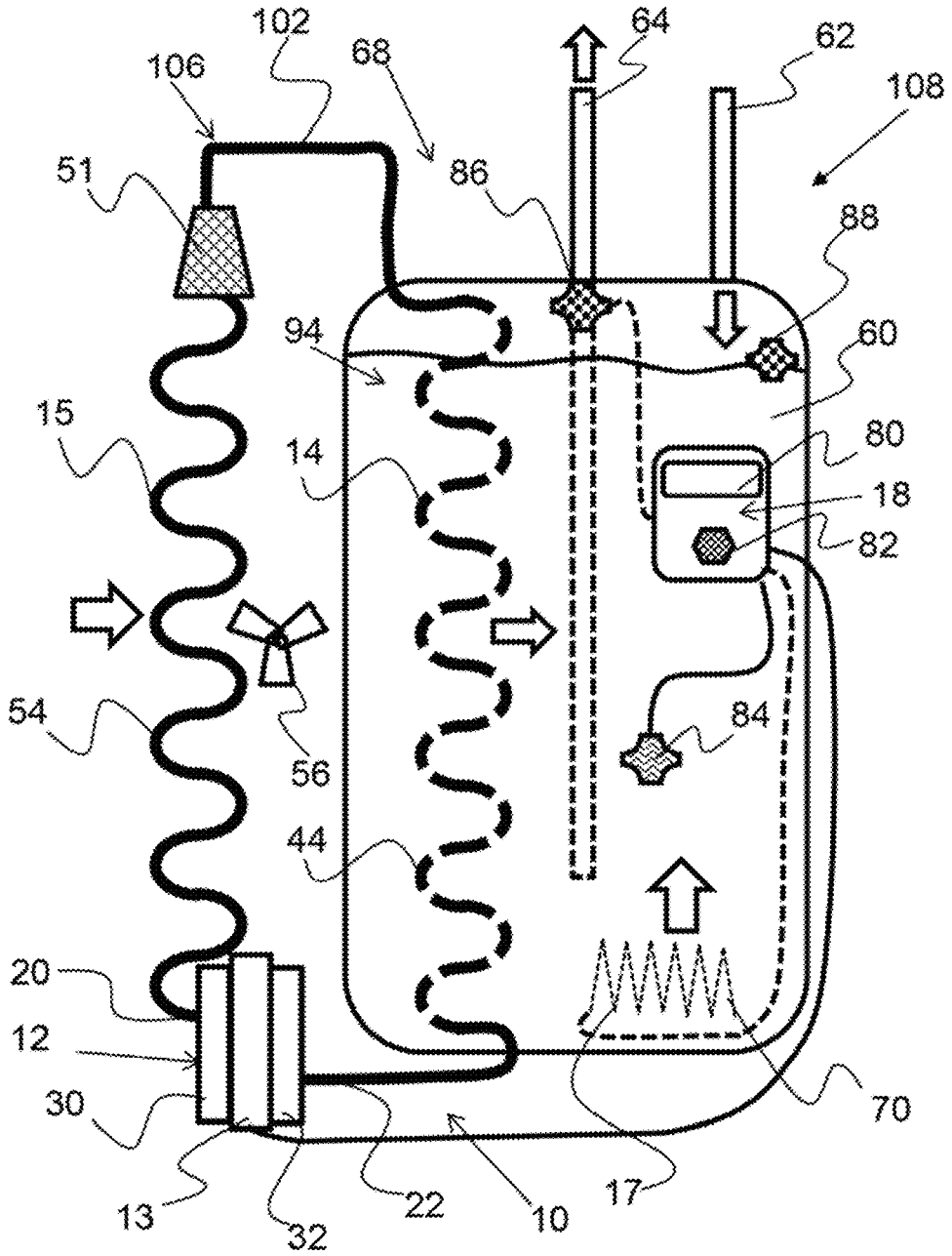

FIG. 6 shows an exemplary hybrid hot water heater having an electrochemical compressor heating device and an electrical type secondary heater.

Figure 7:
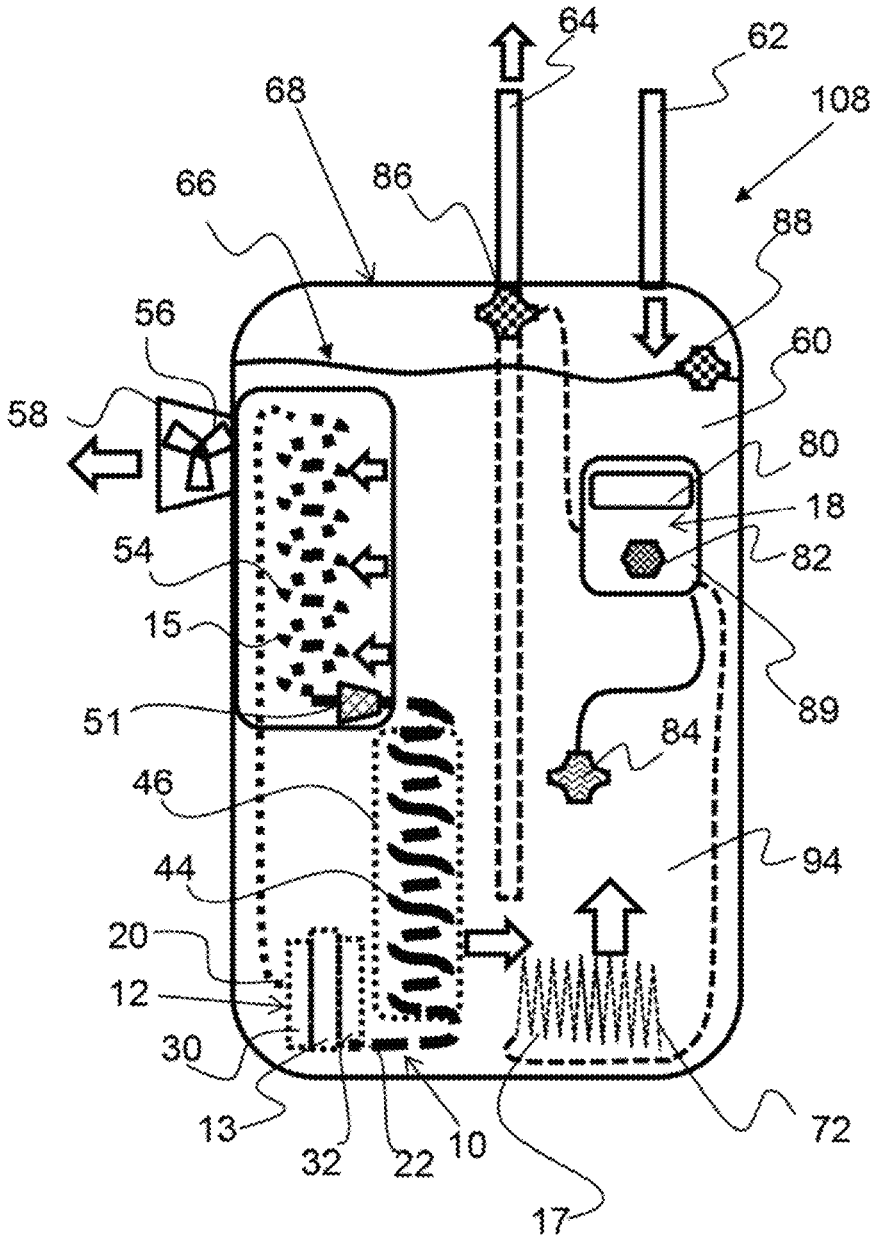

FIG. 7 shows an exemplary hybrid hot water heater having an electrochemical compressor heating device and a gas type secondary heater.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown if FIG. 1, an exemplary electrochemical compressor 12 is configured in a closed loop system 100 having a conduit 102 coupled to the working fluid inlet 20 and working fluid outlet 22 of the electrochemical compressor. The working fluid, within the conduit, flows to the electrochemical compressor, where it is transferred across, and compressed in the electrochemical compressor and thereafter condensed in a condenser. The working fluid temperature and pressure are elevated at the outlet of the compressor. The working fluid is transferred to the condenser where it is substantially condensed in the condenser 14. The heat liberated from condensation of the working fluid may be used to heat an object. This constitutes a heating device 10, as described herein. The working fluid passes from the condenser through an expansion valve 51 and subsequently to an evaporator 15. An object may be put in thermal communication with the evaporator to cool the object. This mechanism may be used to heat a liquid, such as water in a liquid process tank.

As shown in FIG. 2 an exemplary electrochemical compressor, as described herein comprises a membrane electrode assembly (MEA) 13. A working fluid inlet 20 provides the mixed working fluid, water and hydrogen, to the anode 30, where it is chemically reacted on a catalyst 35. The hydrogen is disassociated into protons and electrons, whereby the protons pass through the cation exchange membrane 34 to the cathode 32, and the electrons pass through a circuit. A power supply 28 is coupled to the anode and cathode and drive the reaction rate. The reaction of the anode is shown in FIG. 2 along with the reaction of the cathode. Hydrogen is produced at the cathode and flow out the working fluid outlet 22 along with water. Water is transferred across the cation exchange membrane, as it is pulled along with the protons as they move through the membrane. A gas diffusion layer 36 may be configured on the anode and/or cathode.

As shown in FIG. 3 an exemplary electrochemical compressor, as described herein, has a mixed gas refrigerant 90 being fed into the working fluid inlet 20. A mixed gas refrigerant, as shown comprises a proton associable compound 96 and hydrogen. A proton associable compound may be water, a low molecular alcohol such as methanol, and the like. Any suitable type of working fluid 98 may be used in the electrochemical compressor heating device as described herein.

FIG. 4 shows an exemplary voltage (V) versus current (I) polarization graph for hydrogen gas at different relative humidity levels FIG. 5 shows an exemplary voltage (V) versus current (I) polarization graph for hydrogen gas compressed to different output pressures.

As shown in FIG. 6 an exemplary hybrid hot water heater 68 is configured with an electrochemical compressor heating device 10 and an electrical heater 70 type secondary heater 17. The condenser coils 44 of a condenser 40 are configured within the hybrid hot water heater, where they transfer heat from the working fluid to the water 94. The working fluid conduit 102 extends out of the tank 60 and to an expansion valve 51 where the working fluid is expanded and flows into an evaporator 15. A controller 18 having a user interface 80, such as a touch screen or any outer suitable user input feature, is coupled with both the heating device 10, and the secondary heating device 17. A data processor takes inputs from one or more sensors and determines at what output level each heating source should be operating. A water flow rate sensor 86 is configured on the water outlet 64. The water inlet 82 provides water to the tank 60 of the hybrid hot water heater 68. A temperature sensor 84 is configured to measure the temperature of the water 94 within the tank and a water level sensor 88 measure the water level within the tank. A fan 56 is shown being configured to blow air over the evaporator, whereby the air may be cooled by the cool evaporator coils 54. The cooled air may be used for any suitable purpose including cooling a home, for example. As described, any suitable portion of the electrochemical compressor heating device may be configured with the hot water heater.

As shown in FIG. 7 an exemplary hybrid hot water heater 68 has an electrochemical compressor 12 heating the refrigerant that then flows to device 10 and a gas heater 72 type secondary heater 70. The entire heating device is configured within the outer enclosure of the tank 60 of the hot water heater in this embodiment. In addition, a heat sink 46 is coupled with the condenser coil 44 and draws heat from the condenser, and transfers it to the water 94. The water level 66 of the water within the tank is shown in FIG. 7. A fan 56 is configured to blow cooled air from the evaporator through a duct 58. The water within the hot water heater, or fluid process tank, may be configured as the heat sink and may be in direct contact with the compressor and/or condenser, as described herein.

Any portion of the electrochemical compressor based heating element may be used to heat an object and may be configured with direct contact with a fluid of a fluid process tank, such as a hot water heater. Likewise, any portion of the electrochemical compressor based heating system, as described herein, such as the evaporator and expansion value, may be used to cool an object and may be in direct contact with the object, such as a fluid, or may be coupled with a fins or a heat sink to cool an object. In addition, air or fluid flow over any component including the compressor, condenser, expansion valve, and evaporator may be used to transfer heat to or from the electrochemical compressor based heat transfer system 108, as shown and described in FIGS. 1, 6 and 7.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What claimed is:

1. A hot water heater comprising:

a) a heating device comprising:

i) an electrochemical compressor configured to elevate the temperature of a working fluid, comprising:

a membrane electrode assembly comprising:

an anode;

a cathode;

a cation exchange membrane located between the anode and cathode;

a working fluid inlet coupled with the anode;

a working fluid outlet coupled with the cathode:

a power supply coupled with the anode and the cathode to provide electric current to the electrochemical compressor;

ii) a conduit that couples the working fluid outlet to the working fluid inlet to create a closed loop system for the working fluid;

iii) a condenser coupled with the working fluid outlet, and iv) an evaporator;

wherein both the condenser and the evaporator are configured in the closed loop system, whereby the working fluid is transferred from the electrochemical compressor to the condenser, and from the condenser to the evaporator and wherein the device is configured as a heat pump system;

wherein the working fluid is transferred from the anode to the cathode where it is condensed in the condenser thereby increasing the temperature of the working fluid, wherein the condenser is in thermal communication with the water in the hot water heater, whereby water in the hot water heater is heated by the working fluid;

b) a secondary heat source this is different than the electrochemical heating device and configured to heat water within the hot water tank;

c) a controller;

a temperature sensor coupled with the controller and configured to measure a water temperature of said water within the hot water tank, wherein a voltage differential across the anode and cathode is controlled by the controller, and wherein the voltage across the anode and cathode is changed by the controller to change a rate of flow of the working fluid through the condenser.

2. The hot water heater of claim 1, further comprising:

a) an expansion valve;

b) wherein both the expansion valve and evaporator are configured in the closed loop system, whereby the working fluid is transferred from the electrochemical compressor to the condenser, and from the condenser to the evaporator through the expansion valve.

3. The hot water heater of claim 1, wherein at least a portion the condenser is configured within the hot water heater.

4. The hot water heater of claim 1, wherein a heat sink is coupled with the condenser and the heat sink is configured to transfer heat to water within the hot water heater.

5. The hot water heater of claim 1, wherein the secondary heat source is a gas heater.

6. The hot water heater of claim 1, wherein the secondary heat source is an electrical heater.

7. The hot water heater of claim 1, wherein the temperature sensor is coupled with the controller, whereby the controller regulates the amount of heat produced by the heating device and the secondary heat source as a function of the temperature of the water, as measured by the temperature sensor.

8. The hot water heater of claim 7, further comprising a water flow rate sensor configured to measure an amount of water flow from the hot water heater, wherein the water flow rate sensor is coupled with the controller, whereby the controller regulates the amount of heat produced by the heating device and the secondary heat source as a function of the water flow rate, as measured by the water flow rate sensor.

9. The hot water heater of claim 7, further comprising a water level sensor configured to measure a water level within the hot water heater, wherein the water level sensor is coupled with the controller, whereby the controller regulates the amount of heat produced by the heating device and the secondary heat source as a function of the water level, as measured by the water level sensor.

* * * * *